US005531165A

United States Patent [19]

Taravella et al.

[11] Patent Number: 5,531,165

[45] Date of Patent: Jul. 2, 1996

[54] STRUCTURAL MEMBER FOR USE IN A PALLET OR A SHIPPING CONTAINER

[75] Inventors: Philip Taravella, Grosse Pointe Shores; Edward J. Blair, New Baltimore; Ronald S. Domanski, St. Clair Shores; Joseph C. Shippell, New Baltimore, all of Mich.

[73] Assignee: Anchor Bay Packaging Corporation, St. Chair Shores, Mich.

[21] Appl. No.: 312,824

[22] Filed: Sep. 27, 1994

[51] Int. Cl.[6] ..... B65D 19/00

[52] U.S. Cl. ..... 108/51.3; 108/56.3

[58] Field of Search ..... 108/51.1, 51.3, 108/56.3, 56.1

[56] References Cited

U.S. PATENT DOCUMENTS

| | | | |
|---|---|---|---|
| 2,611,569 | 9/1952 | Coleman et al. | 108/56.3 X |
| 2,997,266 | 8/1961 | Munroe | 108/51.3 |
| 3,000,603 | 9/1961 | Hemann | 108/56.3 X |
| 3,041,029 | 6/1962 | Brown | 108/51.3 |
| 3,115,105 | 12/1963 | Allen | 108/51.3 |
| 3,131,656 | 5/1964 | Houle | 108/51.3 |
| 3,167,038 | 1/1965 | Brown | 108/51.3 |
| 3,675,345 | 7/1972 | Abrams | 108/51.3 X |
| 5,222,444 | 6/1993 | Youell, Jr. et al. | 108/51.3 |
| 5,339,746 | 8/1994 | Vannatta | 108/51.3 X |
| 5,441,154 | 8/1995 | Youell, III | 108/51.3 X |

FOREIGN PATENT DOCUMENTS

| | | | |
|---|---|---|---|
| 1486012 | 3/1966 | France | 108/51.3 |

*Primary Examiner*—Peter M. Cuomo
*Assistant Examiner*—Janet M. Wilkens
*Attorney, Agent, or Firm*—Dykema Gossett

[57] ABSTRACT

The structural member is made from corrugated board or fiberboard and has a longitudinal axis. It comprises a housing having a top wall, a bottom wall and a pair of side walls. A pair of laterally spaced-apart internal dividers are located within the interior of the housing on opposite sides of the axis and extend from one end of the housing to the other end. A plurality of laterally extending reinforcing elements are located within the housing and are supported by the pair of internal dividers. The reinforcing elements have peripheral edges which contact the walls of the housing to provide support for the walls. The structural member is constructed and designed to withstand many pounds of applied force before failure.

8 Claims, 3 Drawing Sheets

STRUCTURAL MEMBER FOR USE IN A PALLET OR A SHIPPING CONTAINER

BACKGROUND OF THE INVENTION

This invention relates to a structural member made entirely from corrugated board or fiberboard and more particularly to a plurality of such structural members which are used to support a platform or container for carrying a load. With such a construction the loaded platform or container may be transported by a conventional forklift truck.

SUMMARY OF THE INVENTION

Various structural members, platforms or pallets and containers for transporting loads such as automotive or industrial parts have been made usually from wood or metal, although in certain instances, shipping containers made from corrugated board have been used. However, the structural members for supporting the shipping containers regardless of the material, have been usually wood or metal.

The structural member of the present invention is made from corrugated board or fiberboard and is constructed in such a way as to withstand, as an example, approximately 225 pounds per line of inch of applied force before failure.

Thus, it is a feature of the present invention to provide a structural member made from corrugated board or fiberboard, having a longitudinal axis and comprising a housing having a top wall, a bottom wall and a pair of side walls. A pair of laterally spaced-apart internal dividers are provided which are located within the interior of the housing on opposite sides of the axis and which extend from one end of the housing to the other end. A plurality of laterally extending reinforcing elements are located within the housing and are supported by the internal dividers. The reinforcing elements have peripheral edges which contact the walls of the housing to provide lateral support for the walls.

Another feature of the present invention is to provide a structural member of the aforementioned type, wherein the internal dividers each has a three ply thickness.

Still another feature of the present invention is to provide a structural member of the aforementioned type, wherein the internal dividers divide the interior of the housing into three compartments of generally equal or varying width.

A further feature of the present invention is to provide a structural member of the aforementioned type, wherein portions of the bottom wall, side walls and the internal dividers are cut to form a pair of laterally extending openings which are adapted to receive the tangs of a forklift.

A still further feature of the present invention is to provide a structural member of the aforementioned type, wherein there are two or more reinforcing elements on each side of the openings.

A still further feature of the present invention is to provide a structural member of the aforementioned type, wherein the reinforcing elements are inwardly set at the ends of the housing.

Another feature of the present invention is to provide a structural member of the aforementioned type, wherein the housing is formed from two separate sections, each section having four perforated score lines, whereby each section is folded at the score lines and together connected by the internal dividers to form the housing with a generally rectangular cross-section.

Still another feature of the present invention is to provide a structural member of the aforementioned type, wherein each of the internal dividers is a corrugated or fiberboard having a pair of longitudinal edges and a series of longitudinally spaced-apart slots extending from one longitudinal edge a predetermined distance toward the other longitudinal edge, with the slots in one of the internal dividers opening upwardly and the slots in the other of the internal dividers opening downwardly, each of the reinforcing elements having spaced-apart parallel grooves in opposing edges which receive portions of the internal dividers in line with the slots to space the internal dividers apart.

A further feature of the present invention is to provide a structural member of the aforementioned type, wherein there are a series of eight slots in each of the internal dividers, each slot in one internal divider having a corresponding slot in the other internal divider and receiving one of the reinforcing elements.

A still further feature of the present invention is to provide an assembly comprising three or more structural members which are spaced-apart and which are held in a spaced-apart relation by corrugated board to form a platform or held apart by the bottom of a corrugated or fiberboard container, with the structural members providing the support for the load placed on the platform or in the container.

It is a further feature of the present invention to provide a corrugated or fiberboard structural member which is easy to manufacture, economical to assemble, and which is capable of withstanding many pounds of applied force before failure.

DETAILED DESCRIPTION OF A PREFERRED EMBODIMENT

Figure 1:
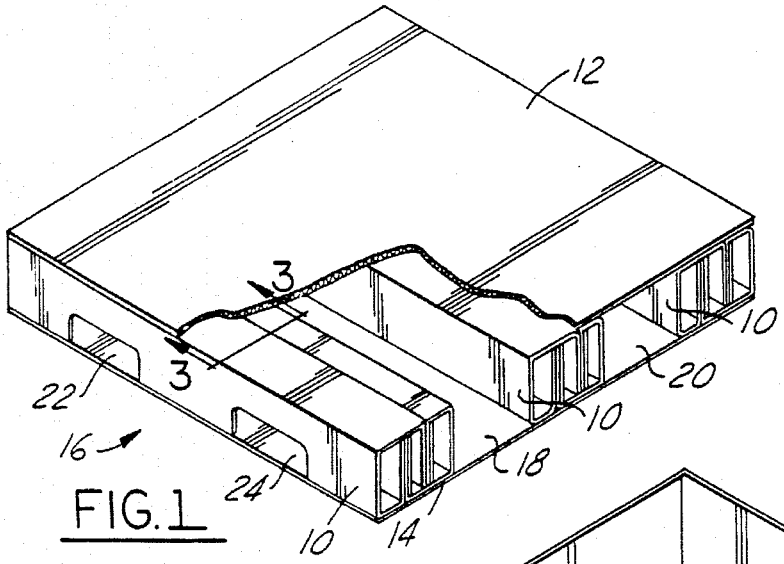
FIG. 1 is a perspective view of a platform, with parts broken away, and utilizing three spaced-apart structural members.

A plurality of structural members, beams or runners 10 are sandwiched between an upper panel 12 and a lower panel 14 to form a platform or pallet 16. The component parts of the platform 16 are made from corrugated or fiberboard or other suitable material which is capable of being formed and assembled in a manner disclosed herein.

The structural members 10 are spaced from one another to form with the panels 12 and 14 straight through passageways 18 and 20 which extend from one side of the platform 12 to the other. Each structural member as will be subsequently described, has a pair of transverse openings 22 and 24 which are parallel to one another as shown in FIG. 1. The first pair of openings 18 and 20 as well as the second pair of openings 22 and 24 are perpendicular to one another. Each pair of openings is arranged to receive the blades or tangs of a forklift truck.

Figure 2:
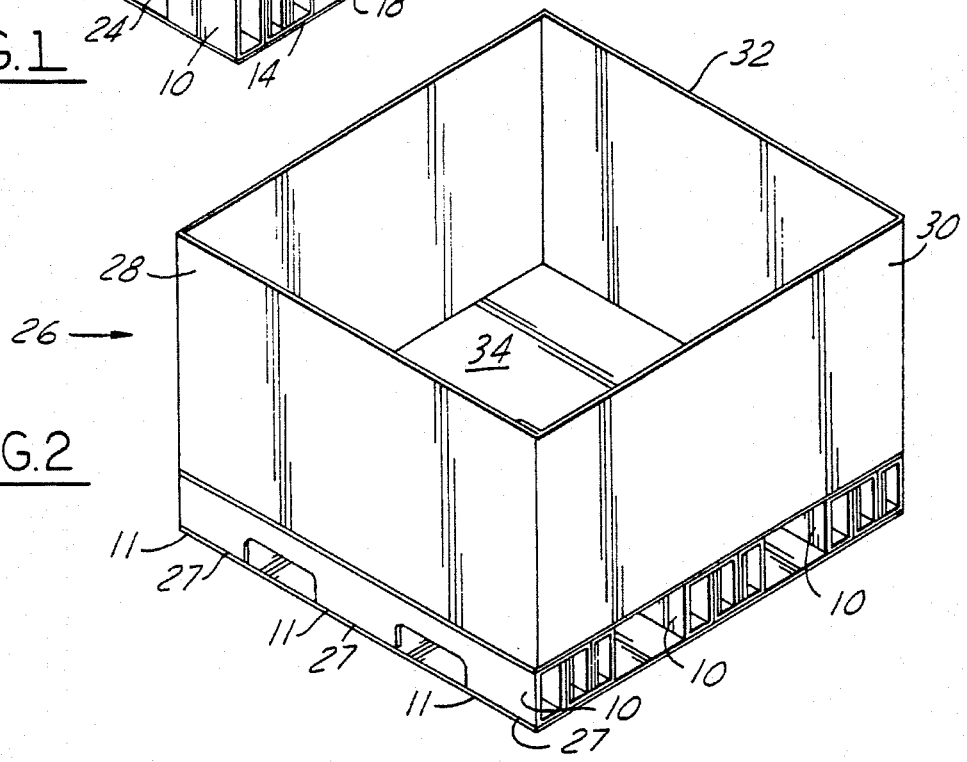
FIG. 2 is a perspective view of a relatively large shipping container incorporating the platform construction of FIG. 1.
Figure 3:
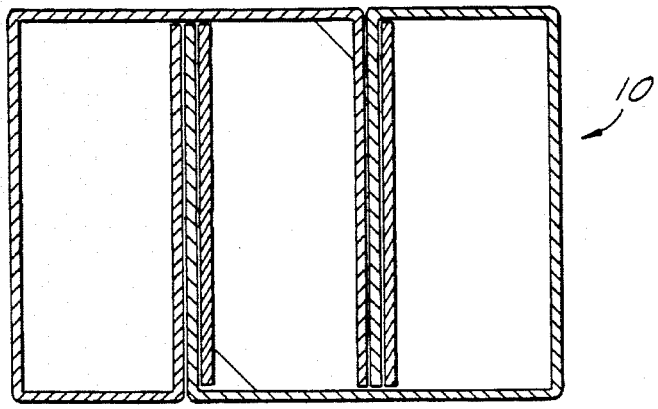
FIG. 3 is a sectional view through one of the structural members taken on the line 3—3 of FIG. 1.

A shipping container 26 is illustrated in FIG. 2. The shipping container 26 has a plurality of upstanding walls or panels 28, 30, 32, and 33. The container includes a bottom 34 to which the runners 10 may be connected or in the alternative the bottom 34 may be mounted directly on and attached to the upper panel 12. The various components may be secured together by suitable adhesives so as to prevent the component parts of the platform 16 or the container 26 from separating. The object of the adhesive layer or bond between the panels is to tie the runners together so as to prevent torquing of the runners.

Figure 4:
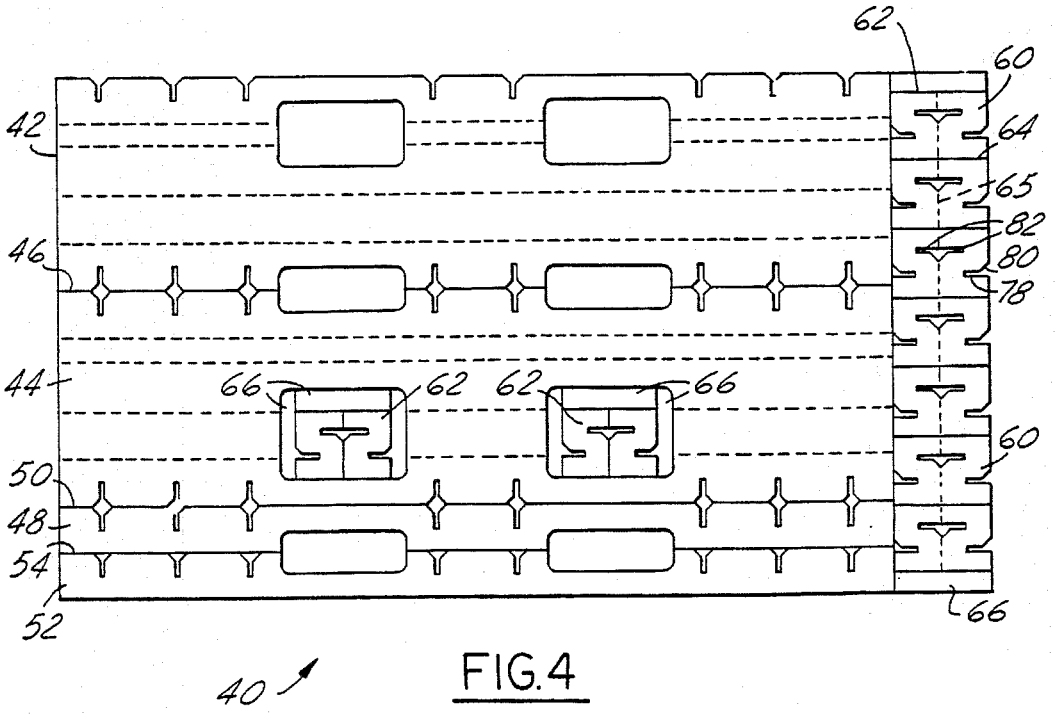
FIG. 4 is a plan view of a sheet or board which has been subjected to one or more processing operations to step, notch, punch, score, perforate and cut a predetermined pattern.

The method of making the structural member 10 includes the use of a corrugated board in sheet form designated by the numeral 40 in FIG. 4. Sheet 40 is subjected to one or more conventional processing or manufacturing steps including notching, punching, scoring, perforating, cuttings or stamping the board or sheet 40 so as to form from one sheet the various component parts required to make and to assemble the structural member or runner 10.

The sheet or board 40 of FIG. 4 contains four elongated sections 42 and 44 separable from one another by a perforated line or zone 46, a stringer or internal divider or section 48 separable from the section 44 by the perforated line or zone 50 and a second stringer or internal divider or section 52 separated or separable from the stringer-section 48 by the perforated line or zone 54.

The panel 40 further has along one edge thereof seven reinforcing spacers 60 which are separable from the panel 40 along the score lines 62 and 64. In addition, section 44 has a pair of reinforcing spacers 62 which are also separable from the section 44 by appropriate score lines provided therein. When the various sections of the sheet 40 are separated from one another it will result in certain minimum scrap designated by the areas 66. The feature of the method disclosed herein in making the component parts of the structural member 10 is to minimize scrap thereby resulting in certain economies of operation.

Referring once again to FIG. 4, the sections 42, 44, 48, and 52 are separated from one another as are the reinforcing spacers or elements 62. The internal elements or sections 48 and 52 are substantially identical. In addition, the internal reinforcing elements or spacers 60 are also identical. The larger elements 42 and 44 are not identical.

The vertical internal elements or members 48 and 52 are comprised with a series of notches 70 having an enlarged V-shape entrance 72. A total of eight notches 70 are provided in each vertical stringer or member 48 and 52.

Each reinforcing spacer 60 has a fold line 65 which divides the spacer 60 into two legs 74 and 76. Each leg 74 and 76 has a slot 78 with an enlarged entrance 80. The opposite portion of each leg is provided with a slot 82 which are interconnected at the fold line 65.

Section 42 is divided into a plurality of zones including zones 90 and 92 which are separated by a fold line 100, zone 94 which is connected to zone 92 by a fold line 102, zone 96 which is connected to zone 94 about the fold line 104, and zone 98 which is connected to the zone 96 by the fold line 106.

Figure 5:
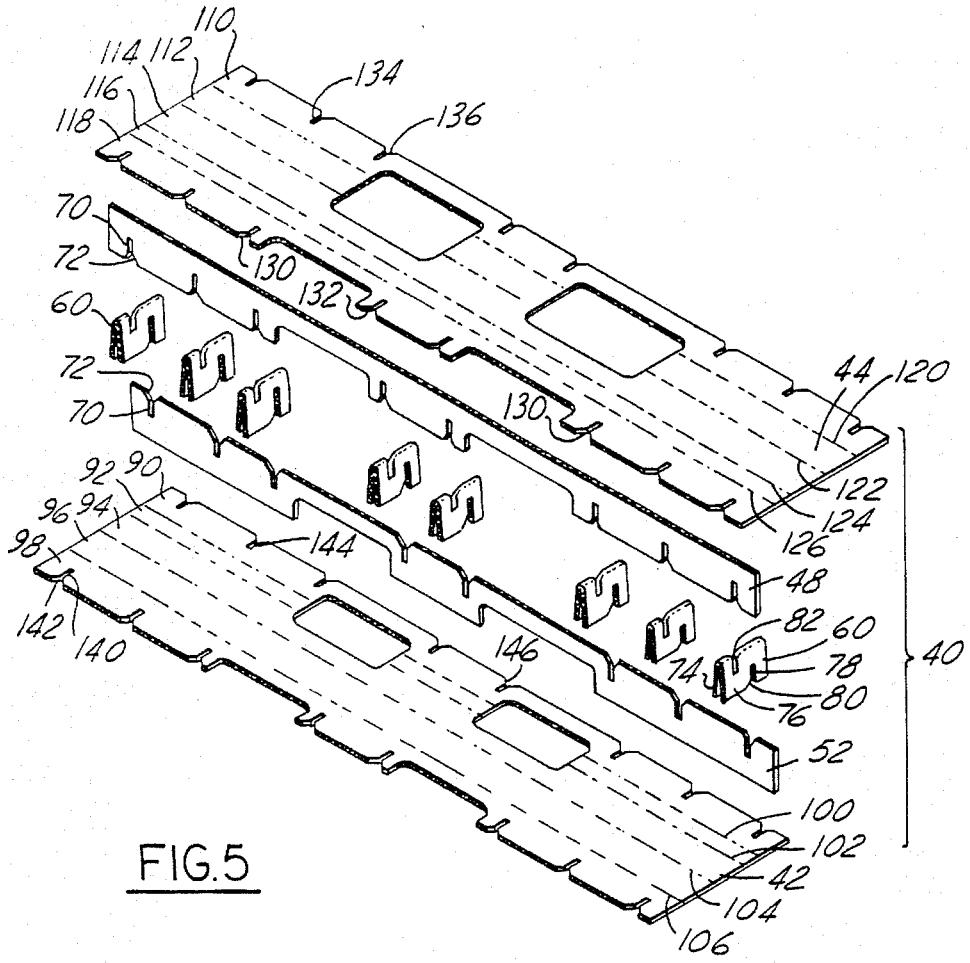
FIG. 5 is an exploded view of the various sections and elements which have been separated from the board of FIG. 4.

The other section 44 of sheet 40 includes a plurality of zones 110, 112, 114, 116, and 118 as shown in FIG. 5. Zone 110 is connected to zone 112 by a fold line or score line 120. Zone 114 is connected to zone 112 by a score or fold line 122 while the zone 116 is connected to the zone 114 by a fold or score line 124. Finally, the zone 118 is connected to the zone 116 by a fold line 126.

Having identified the component parts of the structural member 10 which are taken from the preformed sheet 40, your attention is now directed to FIGS. 6–9, inclusive.

Figure 6:
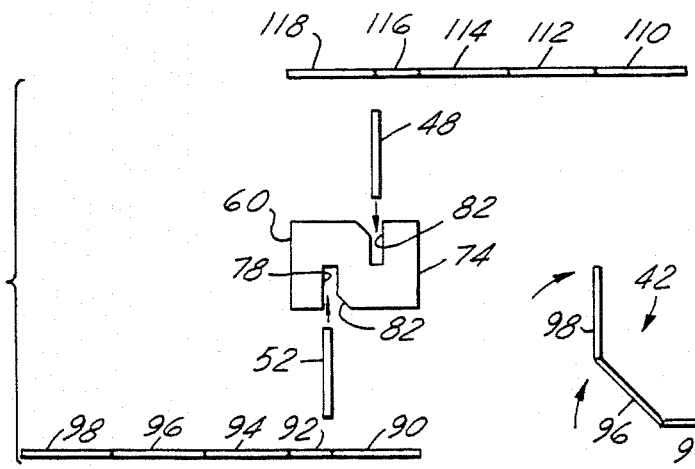
FIGS. 6–8 are views illustrating the manner in which the component section and parts shown in FIG. 5 are folded in order to form the structural member.
Figure 7:
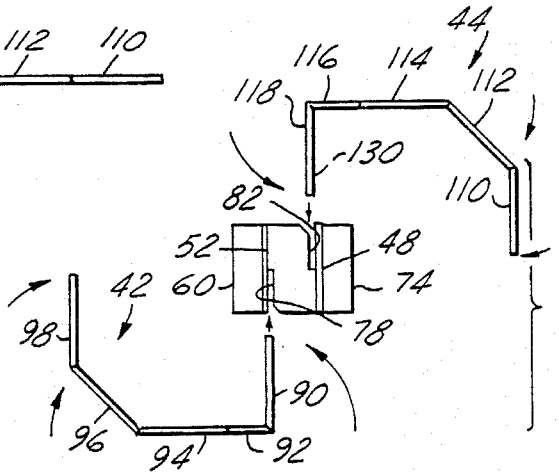

In assembling the components of the structural member 10, the eight reinforcing spacers 60 are folded as shown in FIG. 5 with slots 78 facing downwardly and the slots 82 facing upwardly. Thereafter, internal divider 48, having the eight slots 70 facing downwardly, is inserted into the upwardly opening slots 82 of the reinforcing spacers 60. Thereafter, the second stringer or internal divider 52, having the slots 70 facing upwardly are inserted into the slots 78 of the reinforcing spacers 60. The connection of the reinforcing spacers 60 with the stringers or internal dividers 48 and 52 are shown in FIG. 6. Once assembled, the resulting structure is illustrated in FIG. 7. It should be noted in FIG. 7 that the stringers 48 and 52 do not occupy the entire space defined by the slots 82 and 78.

The elongated section 44 has the zones 110 and 118 bent or folded along the fold lines as shown in FIG. 7. Zone 118 at the longitudinal edge thereof is provided with eight spaced-apart slots 130 (FIG. 5) having enlarged entrances 132. The other longitudinal edge along zone 110 also has a plurality of slots 134 with enlarged openings 136.

Figure 8:
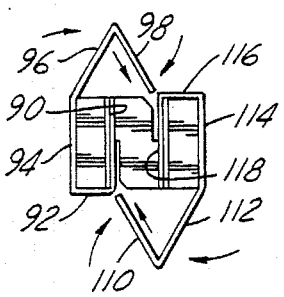

In further assembly of the structural member 10, the zone 118 of the elongated section 44, having the slots 130 facing downwardly, is inserted over or into the reinforcing elements or spacers 60 to occupy the remaining space of slots 82 as shown in FIGS. 7 and 8.

In addition, the elongated section 42 also has along each longitudinal edge thereof a plurality of slots, eight slots in number, along each edge. Zone 98 has a plurality of slots 140 with enlarged openings 142 while the zone 90 has slots 144 with enlarged openings 146. Zone 90, with the slots 144 opening upwardly, is interconnected to the reinforcing spacers 60 in the manner shown in FIG. 7 where the zone 90 fits into the remaining spaces provided by slots 78 in the reinforcing elements 60.

Figure 9:
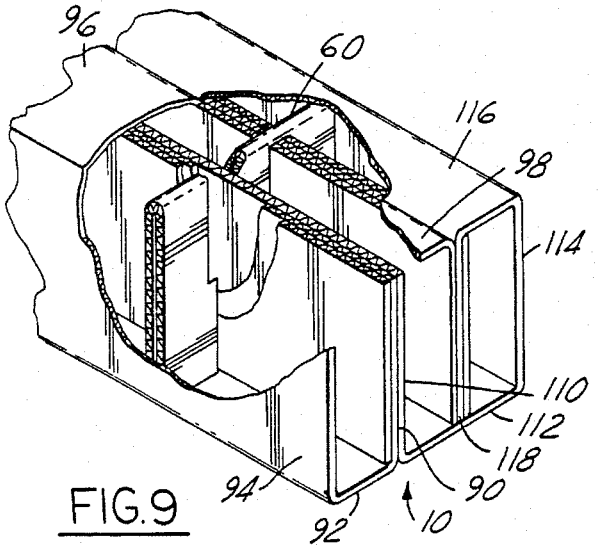
FIG. 9 is a fragmentary enlarged view of the structural member, with parts broken away in order to illustrate the assembled structural member in the manner in which the reinforcing spacers extend laterally across the structural member.

Once the reinforcing sections 42 and 44 have been appropriately connected to the reinforcing elements or spacers 60, it is then necessary to fold, bend or otherwise manipulate the other zones of the elongated sections 42 and 44 in the manner and directions illustrated in FIGS. 8 and 9 to close the housing.

Specifically, with respect to elongated section 44, zone 116 of the elongated section 44 extends across the top of the reinforcing spacers 50 and the connected zone 114 extends vertically downwardly, as shown in FIGS. 8 and 9, along the side of the reinforcing spacers 60. Zone 112 is folded so as to extend across part of the bottom of the spacers 60 in the manner shown in FIGS. 8 and 9, with the final zone 110 having the upwardly opening slots 134 provided therein extending into the remaining spaces of slots of the reinforcing spacers 60 so as to be locked or retained therein as shown in FIG. 9.

The elongated section 42 is also connected to the reinforcing elements in a similar manner, with zone 90, having upwardly opening slots being carried by the reinforcing elements 60. Zone 92 extends across the bottom of the reinforcing spacers and zone 94 extends vertically upwardly. Zone 96 extends across the top of the reinforcing spacers 60 with the final zone 98, provided with the downwardly openings slots 140, extending into the remaining spaces of the reinforcing elements 60 and carried thereby.

ALTERNATE CONSTRUCTIONS

The structural members or beams 10 may be adhesively secured to upper and lower panels 12 and 14 as shown in FIG. 1 to form a pallet or platform 16. It should be appreciated rather than using a full panel 14 strips may be provided on the bottom or at the top so as to secure the structural members together and to hold them in spaced-apart relations to form the panel.

With respect to the shipping container 26 shown in FIG. 2, the structural members 10 may be connected by a series of elongated strips 11 which tie the structural members 10 together; or in the alternative, a lower panel like panel 14 of FIG. 1 may be used. In addition as a further modification, in certain applications, no pads, strips of bottoms need be provided for the structural members 10 since they are tied together and held in spaced-apart relation by the shipping container provided at the top of the structural members 10.

It should be understood that any embodiment of the invention that has been described in detail may be subjected to modifications and other embodiments may incorporate the inventive features. Accordingly, it is intended that the foregoing disclosure is to be considered as illustrating the principals of the present invention, of those features and not as a delimiting description, which is the purpose of the claims that follow.

What is claimed is:

1. A structural member made from corrugated board and having a longitudinal axis comprising:

a housing having a top wail, a bottom wall and a pair of side walls;

a pair of laterally spaced apart internal dividers located within the interior of said housing on opposite sides of the axis and extending from one end of said housing to the other end;

a plurality of laterally extending reinforcing elements located within said housing and being supported by said internal dividers, said reinforcing elements having peripheral edges which contact the walls of said housing to provide support for said walls; and each of said internal dividers having a three ply thickness.

2. A structural member made from corrugated board and having a longitudinal axis comprising:

a housing having a top wall, a bottom wall and a pair of side walls;

a pair of laterally spaced apart internal dividers located within the interior of said housing on opposite sides of the axis and extending from one end of said housing to the other end;

a plurality of laterally extending reinforcing elements located within said housing and being supported by said internal dividers, said reinforcing elements having peripheral edges which contact the walls of said housing to provide support for said walls;

said internal dividers dividing the interior of said housing into three compartments of generally equal width.

3. The structural member defined in claim 2, wherein portions of said bottom wall, said side walls and said internal dividers are cut to form a pair of laterally extending openings which are adapted to receive the tangs of a forklift.

4. The structural member defined in claim 3, wherein there are two or more reinforcing elements on each side of said openings.

5. The structural member defined in claim 3, wherein said reinforcing elements are inwardly set at the end of said housing.

6. A structural member made from corrugated board and having a longitudinal axis comprising:

a housing having a top wall, a bottom wall and a pair of side walls;

a pair of laterally spaced apart internal dividers located within the interior of said housing on opposite sides of the axis and extending from one end of said housing to the other end;

a plurality of laterally extending reinforcing elements located within said housing and being supported by said internal dividers, said reinforcing elements having peripheral edges which contact the walls of said housing to provide support for said walls;

said housing being formed from two separate sections, each section having four perforated score lines, whereby each section is folded at the score lines and together connected by said internal dividers to form said housing with a generally rectangular cross-section.

7. A structural member made from corrugated board and having a longitudinal axis comprising:

a housing having a top wall, a bottom wall and a pair of side walls;

a pair of laterally .spaced apart internal dividers located within the interior of said housing on opposite sides of the axis and extending from one end of said housing to the other end;

a plurality of laterally extending reinforcing elements located within said housing and being supported by said internal dividers, said reinforcing elements having peripheral edges which contact the walls of said housing to provide support for said walls;

each of said internal dividers is made from a corrugated board having a pair of longitudinal edges and a series of longitudinally spaced apart slots extending from one longitudinal edge a predetermined distance towards the other longitudinal edge, the slots in one of said internal dividers opening upwardly and the slots in the other of said internal dividers opening downwardly;

each of said reinforcing elements having spaced apart parallel grooves in opposing edges which receive portions of said internal dividers in line with said slots to space said internal dividers apart.

8. The structural member defined in claim 7, wherein there are a series of slots in each of said internal dividers, each slot in one internal divider having a corresponding slot in the other internal divider and receiving one of the reinforcing elements.

* * * * *